US008830650B2

(12) United States Patent
Suzuki et al.

(10) Patent No.: US 8,830,650 B2
(45) Date of Patent: Sep. 9, 2014

(54) IONIZER AND STATIC CHARGE ELIMINATING METHOD

(75) Inventors: Satoshi Suzuki, Moriya (JP); Nobuhiro Fujiwara, Moriya (JP); Masayuki Orihara, Kuki (JP)

(73) Assignee: SMC Kabushiki Kaisha, Tokyo (JP)

( * ) Notice: Subject to any disclaimer, the term of this patent is extended or adjusted under 35 U.S.C. 154(b) by 330 days.

(21) Appl. No.: 12/961,871

(22) Filed: Dec. 7, 2010

(65) Prior Publication Data

US 2011/0134580 A1 Jun. 9, 2011

(30) Foreign Application Priority Data

Dec. 9, 2009 (JP) ..... 2009-279789

(51) Int. Cl.
*H01T 23/00* (2006.01)

(52) U.S. Cl.
CPC ..... *H01T 23/00* (2013.01)
USPC ..... 361/230

(58) Field of Classification Search
USPC ..... 361/230
See application file for complete search history.

(56) References Cited

U.S. PATENT DOCUMENTS

| | | | |
|---|---|---|---|
| 6,693,788 | B1 | 2/2004 | Partridge |
| 7,479,615 | B2 * | 1/2009 | Gefter et al. ..... 219/121.36 |
| 7,586,731 | B2 | 9/2009 | Sato et al. |
| 7,973,292 | B2 | 7/2011 | Tsumori et al. |
| 2002/0130269 | A1 | 9/2002 | Fujii |

FOREIGN PATENT DOCUMENTS

| | | | |
|---|---|---|---|
| CN | 1972551 | A | 5/2007 |
| CN | 101563961 | A | 10/2009 |
| EP | 2104405 | * | 9/2009 |
| JP | 2000-058290 | | 2/2000 |
| JP | 2007-258073 | | 10/2007 |
| JP | 2008-226647 | | 9/2008 |
| JP | 2008-288072 | | 11/2008 |
| WO | WO 2007/122742 | | 1/2007 |

OTHER PUBLICATIONS

Chinese Office Action dated Nov. 8, 2013, issued in corresponding Chinese Application No. 201010592335.9 (with English translation).
Office Action dated Aug. 20, 2013 issued in corresponding Japanese Application No. 2009-279789, published Oct. 4, 2007 (w/machine English translation of pertinent portion).
Office Action dated Aug. 20, 2013 issued in corresponding Japanese Application No. 2009-279789 (w/machine English translation of pertinent portion).

* cited by examiner

*Primary Examiner* — Rexford Barnie
*Assistant Examiner* — Tien Mai
(74) *Attorney, Agent, or Firm* — Oblon, Spivak, McClelland, Maier & Neustadt, L.L.P.

(57) ABSTRACT

An ionizer includes two needle electrodes, and a high voltage generating unit for applying a first AC voltage to one of the needle electrodes, and for applying a second AC voltage, having a frequency higher than a frequency of the first AC voltage, to another of the needle electrodes. Static charge of a charged body is eliminated by releasing generated positive ions or negative ions, which are generated in the vicinity of the needle electrodes, toward the body.

7 Claims, 12 Drawing Sheets

<PATTERN A (ION GENERATION)>

<PATTERN B (POSITIVE ION RELEASE)>

<PATTERN C (ION GENERATION)>

<PATTERN D (NEGATIVE ION RELEASE)>

<PATTERN A' (ION GENERATION)>

<PATTERN C' (ION GENERATION)>

IONIZER AND STATIC CHARGE ELIMINATING METHOD

CROSS-REFERENCE TO RELATED APPLICATION

This application is based upon and claims the benefit of priority from Japanese Patent Application No. 2009-279789 filed on Dec. 9, 2009, of which the contents are incorporated herein by reference.

BACKGROUND OF THE INVENTION

1. Field of the Invention

The present invention relates to an ionizer and static charge eliminating method for eliminating static charge in a static charge elimination region.

2. Description of the Related Art

Heretofore, ionizers, which utilize corona discharge, have been known as one type of static charge eliminating apparatus for eliminating static electricity within a static charge elimination region (e.g., on a body charged with static electricity). See, for example, U.S. Pat. No. 6,693,788, Japanese Laid-Open Patent Publication No. 2008-288072, and International Publication No. WO2007/122742. Such ionizers release to the static charge elimination region positive ions or negative ions, which are generated by corona discharge caused by application of high voltage to electrodes, whereupon the static electricity contained within the static charge elimination region is eliminated by the positive ions or the negative ions.

An explanation shall now be made with reference to FIGS. 8A through 12B concerning the ionizers disclosed in U.S. Pat. No. 6,693,788, Japanese Laid-Open Patent Publication No. 2008-288072, and International Publication No. WO2007/122742. For facilitating such explanations, in FIGS. 8A through 12B, portions of the structural elements thereof are shown as exaggerated or schematic representations.

As shown in FIG. 8A, the ionizer according to the specification of U.S. Pat. No. 6,693,788 is equipped with a needle electrode 100, and ground electrodes 102, which are arranged between the body 104 from which static charge is to be eliminated and the needle electrode 100. In the case that, for example, an AC voltage having a period of T and a duty ratio of 50% (i.e., a high voltage in which an applied voltage of +V and an applied voltage of −V are repeated reciprocally) is applied to the needle electrode 100, a non-illustrated electric field (lines of electric force) is formed between the needle electrode 100 and the ground electrodes 102 that confront the needle electrode 100. Owing thereto, an electric field concentration is generated at the tip end of the needle electrode 100, and by means of corona discharge that is caused by the electric field concentration, in the positive half-period of the AC voltage (+V applied voltage), positive ions 106 are generated in the vicinity of the tip portion (see FIG. 9A), whereas, in the negative half-period of the AC voltage (−V applied voltage), negative ions 108 are generated in the vicinity of the tip portion (see FIG. 9B).

Accordingly, by passing the positive ions 106 or the negative ions 108 between the two ground electrodes 102 (i.e., through an opening provided in the ionizer) and releasing such ions toward the body 104, the electric charge (static electricity), which has charged the body 104, is eliminated.

Further, as shown in FIG. 8B, the AC voltage is switched between positive and negative polarities at a timing indicated by times $t_{50}$, $t_{51}$, $t_{52}$, $t_{53}$, $t_{54}$, $t_{55}$.

As shown in FIG. 10, in the ionizer disclosed in Japanese Laid-Open Patent Publication No. 2008-288072, when ionization is observed from the body 104, two needle electrodes 100*a*, 100*b* are arranged between two ground electrodes 102. In this case, when a +V direct current voltage is applied to one of the needle electrodes 100*a* and a −V direct current voltage is applied to the other of the needle electrodes 100*b*, the electric fields are added to the region between the needle electrode 100*a* and the ground electrode 102, as well as between the needle electrode 100*b* and the ground electrode 102, and a non-illustrated electric field (lines of electric force) is formed between the needle electrode 100*a* and the needle electrode 100*b*. As a result, positive ions 106 are generated in large quantities in the vicinity of the tip end of the needle electrode 100*a*, whereas negative ions 108 are generated in large quantities in the vicinity of the tip end of the needle electrode 100*b*, due to the corona discharge caused by the electric field concentrations generated at the tip ends of the needle electrodes 100*a*, 100*b*. The positive ions 106 and the negative ions 108 pass through openings between each of the ground electrodes 102 and are released respectively toward the body 104, whereupon static electricity of the body 104 is eliminated.

As shown in FIG. 11A, International Publication No. WO2007/122742 discloses a structure in which ground electrodes 102 (refer to FIG. 8A and FIGS. 9A though 10) are not necessary. In this case, an AC voltage as shown in FIG. 11B is applied to one of the needle electrodes 100*a*, and an AC voltage as shown in FIG. 11C, which is 180° opposite in phase with respect to the aforementioned AC voltage, is applied to the other of the needle electrodes 100*b*. Further, as shown in FIGS. 11B and 11C, the respective AC voltages are switched between positive and negative polarities at a timing indicated by times $t_{60}$, $t_{61}$, $t_{62}$, $t_{63}$, $t_{64}$, $t_{65}$.

As a result thereof, for example, as shown in FIG. 12A, when an applied voltage of +V (see FIG. 11B) is applied to the needle electrode 100*a* and an applied voltage of −V (see FIG. 11C) is applied to the needle electrode 100*b*, non-illustrated electric fields (lines of electric force) are formed between each of the needle electrodes 100*a*, 100*b*, and large electric field concentrations are generated at each of the tip ends of the needle electrodes 100*a*, 100*b*. By means of corona discharge that is caused by the electric field concentrations, positive ions 106 are generated in large quantities in the vicinity of the tip portion of the needle electrode 100*a*, whereas negative ions 108 are generated in large quantities in the vicinity of the tip portion of the needle electrode 100*b*. The positive ions 106 migrate toward the needle electrode 100*b* along the lines of electric force, and the negative ions 108 migrate toward the needle electrode 100*a* along the lines of electric force.

Additionally, at a switchover timing between positive and negative polarities at times $t_{61}$, $t_{63}$, $t_{65}$, when the voltage level of the needle electrodes 100*a*, 100*b* becomes zero, as shown in FIG. 12B, the positive ions 106 and the negative ions 108 between the needle electrodes 100*a*, 100*b* are released toward the body 104, whereupon static electricity is eliminated from the body 104. Further, in FIGS. 12A and 12B, groupings of positive ions 106 or negative ions 108 are shown by the broken line regions that surround the positive ions 106 or the negative ions 108.

However, with the ionizer according to the specification of U.S. Pat. No. 6,693,788, as shown in FIGS. 9A and 9B, because positive ions 106 and negative ions 108 are induced and absorbed by the ground electrodes 102 along the non-illustrated lines of electric force, which are formed between the needle electrode 100 and the ground electrodes 102, the number of positive ions 106 or negative ions 108 that actually reach the body 104 is reduced.

On the other hand, the ionizer of Japanese Laid-Open Patent Publication No. 2008-288072 shown in FIG. 10 is capable of generating positive ions 106 or negative ions 108 in large quantities, because the electric field concentration at the tip ends of the needle electrodes 100*a*, 100*b* is large compared to the ionizer disclosed in the specification of U.S. Pat. No. 6,693,788 (see FIGS. 8A to 9B). Notwithstanding, similar to the case of U.S. Pat. No. 6,693,788, positive ions 106 and negative ions 108 tend to be induced and absorbed respectively by the ground electrodes 102. Further, the positive ions 106 migrate toward the needle electrode 100*b*, whereas the negative ions 108 migrate toward the needle electrode 100*a*. Owing thereto, the positive ions 106 and the negative ions 108 join together during migration thereof, and the negative ions 108 are induced and absorbed by the needle electrode 100*a*, and in addition, the positive ions 106 are induced and absorbed by the needle electrode 100*b*. As a result, even though positive ions 106 and negative ions 108 are generated in large quantities, the number of positive ions and negative ions required to eliminate static electricity from the body 104 cannot be increased. Consequently, with the ionizer of Japanese Laid-Open Patent Publication No. 2008-288072, large quantities of ions are generated uselessly.

With respect to this problem, with the ionizer of International Publication No. WO2007/122742 shown in FIGS. 11A to 12B, since the ground electrodes 102 (see FIG. 8A and FIGS. 9A to 10) are made unnecessary, induction and absorption of the positive ions 106 and the negative ions 108 by such ground electrodes 102 can be avoided. However, in the case that switching is carried out between positive and negative portions of the AC voltage at the timing of times $t_{60}$, $t_{61}$, $t_{62}$, $t_{63}$, $t_{64}$, $t_{65}$, because the polarity of the AC voltage applied to the needle electrodes 100*a*, 100*b* is switched immediately after the positive ions 106 and the negative ions 108 are directed and released toward the body 104, the positive ions 106 and the negative ions 108 that are directed toward the body merge together, whereupon the positive ions 106 and the negative ions 108 are induced and absorbed by the needle electrodes 100*a*, 100*b* immediately after switching in polarity. As a result, the number of positive ions 106 and negative ions 108 that are released toward the body 104 is reduced.

In this manner, with the ionizers disclosed in U.S. Pat. No. 6,693,788, Japanese Laid-Open Patent Publication No. 2008-288072, and International Publication No. WO2007/122742, the generation efficiency of ions (release rate of ions from the ionizer) needed to eliminate static electricity from the body is reduced, and consequently, the efficiency at which static electricity is eliminated by such ionizers is low.

With respect to the aforementioned problems, it can be considered to arrange the ground electrodes rearwardly of the needle electrodes 100, 100*a*, 100*b* and to increase the electric field concentration at the tip ends of the needle electrodes 100, 100*a*, 100*b*, or alternatively, to raise the voltage level of the needle electrodes 100, 100*a*, 100*b*. However, in the event that the ground electrodes are positioned rearwardly of the needle electrodes 100, 100*a*, 100*b*, because it is necessary to secure space for arrangement of the ground electrodes, the ionizer is made larger in scale. On the other hand, in the case that the voltage level is raised to cause generation of ions in large quantities, due to the above-described problems with U.S. Pat. No. 6,693,788, Japanese Laid-Open Patent Publication No. 2008-288072, and International Publication No. WO2007/122742, static electricity elimination efficiency cannot be increased. Further, because in order to raise the voltage level, a high voltage generator for generating higher voltage is needed, in this case as well, the ionizer is made larger in scale.

SUMMARY OF THE INVENTION

An object of the present invention is to increase the efficiency with which static electricity is eliminated in a static charge elimination region, by improving the generation efficiency of ions (i.e., the efficiency at which ions are released from an ionizer).

To achieve the aforementioned object, an ionizer according to the present invention comprises at least two electrodes, and a high voltage generating unit for applying a first AC voltage to a first electrode from among the at least two electrodes, and for applying a second AC voltage, having a frequency higher than a frequency of the first AC voltage, to a second electrode from among the at least two electrodes.

Further, to achieve the aforementioned object, a static charge eliminating method according to the present invention comprises the steps of generating positive ions and negative ions by applying a first AC voltage to a first electrode from among at least two electrodes, and by applying a second AC voltage, having a frequency higher than a frequency of the first AC voltage, to a second electrode from among the at least two electrodes, and then eliminating static charge of a static charge elimination region by releasing the generated positive ions or the generated negative ions to the static charge elimination region.

As described previously, with the ionizers of U.S. Pat. No. 6,693,788, Japanese Laid-Open Patent Publication No. 2008-288072, and International Publication No. WO2007/122742, even if positive ions or negative ions are generated in large quantities caused by corona discharge, because the number of positive ions 106 and negative ions 108 that are actually released toward the static charge elimination region (body 104) is decreased due to the existence of the ground electrodes (see FIGS. 8A, 9A, 9B and 10), or by releasing the positive ions 106 and negative ions 108 (see FIG. 12B) at a timing at which the polarities are switched, the static charge elimination efficiency of static electricity within the static charge elimination region is low.

Consequently, with the present invention, the frequency of the second AC voltage applied to the second electrode is set higher than the frequency of the first AC voltage applied to the first electrode.

Owing thereto, due to the polarity of the AC voltage that is applied to the first electrode and the second electrode, a timespan at which the AC voltages applied to the first electrode and the second electrode are mutually different (i.e., a timespan at which one of the electrodes becomes positive in polarity while the other of the electrodes becomes negative in polarity), and a timespan at which the AC voltages applied to the first electrode and the second electrode are mutually the same (i.e., a timespan at which the polarities of one of the electrodes and the other of the electrodes respectively are both positive or negative in polarity) are generated.

In this case, during the timespan when the polarities are mutually different, positive ions and negative ions are generated in the vicinity of each of the electrodes. Further, during the timespan when the polarities are mutually the same, because the polarity of the ions generated in the vicinity of each of the electrodes also become mutually the same, the ions are released toward the static charge elimination region from the ionizer as a result of a repulsive force that operates between the ions and each of the electrodes.

Stated otherwise, with the present invention, because the ground electrodes 102 are not needed, the problems of U.S. Pat. No. 6,693,788 and Japanese Laid-Open Patent Publication No. 2008-288072, in which ions are induced and absorbed by the ground electrodes 102, and the number of ions released toward the static charge elimination region are reduced, can be avoided.

Further, because separately from the timespan during which positive ions and negative ions are generated, a timespan is provided in which the positive ions and the negative ions are released, it is unnecessary for such positive ions and negative ions to be released at a timing corresponding to a switch in polarity. Accordingly, positive ions and negative ions can be released reliably toward the static charge elimination region, without reducing the number of positive ions and negative ions that are generated.

Furthermore, according to the present invention, as described above, the frequency of the second AC voltage is set higher than the frequency of the first AC voltage. Owing thereto, the timespan during which the aforementioned polarities are mutually different (i.e., a timespan when positive ions and negative ions are generated), and the timespan during which the aforementioned polarities are mutually the same (i.e., a timespan when generated positive or negative ions are released into a static charge elimination space), in either case, are shorter than the time of positive polarity or the time of negative polarity in the first AC voltage. Nevertheless, with the present invention, by reciprocally repeating those timespans, before the positive ions or the negative ions are induced and absorbed by the electrodes following switching in polarity, by use of the repulsive force, the positive ions or the negative ions can be released as is toward the static charge elimination region.

Accordingly, with the present invention, the problems of International Publication No. WO2007/122742 also can be avoided.

In this manner, with the present invention, compared to the disclosures of U.S. Pat. No. 6,693,788, Japanese Laid-Open Patent Publication No. 2008-288072, and International Publication No. WO2007/122742, by providing the timespan at which positive ions and negative ions are released by the repulsive force toward the static charge elimination region, the positive ions and the negative ions can be released efficiently and reliably to the static charge elimination region. As a result, static electricity at the static charge elimination region can be eliminated highly efficiently.

Stated otherwise, according to the present invention, even if ions are not generated in large quantities as in the inventions of U.S. Pat. No. 6,693,788, Japanese Laid-Open Patent Publication No. 2008-288072, and International Publication No. WO2007/122742, by setting the frequency of the first AC voltage and the frequency of the second AC voltage in accordance with the aforementioned relationship, the generated positive ions and negative ions are released reliably to the static charge elimination region, whereby the efficiency with which static electricity is eliminated is increased. Owing thereto, it is unnecessary to dispose ground electrodes behind the first electrode and the second electrode, or to increase the voltage level of the AC voltage that is applied to the first electrode and the second electrode.

Accordingly, with the present invention, by improving the generation efficiency of ions (ion release efficiency), the charge elimination efficiency of static electricity at the static charge elimination region can be increased. Owing thereto, a reduction in size and scale of the ionizer can be realized.

Preferably, when n is taken as a positive integer, the frequency of the second AC voltage is set to be 3*n* times greater than the frequency of the first AC voltage. Owing thereto, because the timespan during which the aforementioned positive ions and negative ions are generated and the timespan during which the positive ions and negative ions are released to the static charge elimination space are repeated reciprocally, ineffectual generation of positive ions and negative ions can be avoided, and elimination of static electricity can be performed with good efficiency.

Further, the high voltage generating unit may apply the second AC voltage to the second electrode in a state wherein a positive/negative switchover timing of the second AC voltage is shifted with respect to a positive/negative switchover timing of the first AC voltage.

As a result thereof, reciprocal repetition of the timespan during which the positive ions and the negative ions are generated, and the time span during which the positive ions and the negative ions are released to the static charge elimination region can be realized reliably. As a result, the generation efficiency (irradiation efficiency) of the positive ions and the negative ions can be increased, and the efficiency with which static electricity is eliminated can be improved remarkably. In this manner, by improving the static charge elimination efficiency, the reliability of the ionizer can be increased.

In addition, if the first electrode and the second electrode are constituted by needle electrodes, because large electric field concentrations are generated at the tip ends of such needle electrodes, by means of corona discharge caused by the electric field concentrations, positive ions and negative ions can easily be generated. More specifically, as stated previously, because the present invention is constituted without need for the ground electrodes, the degree of electric field concentration and the generated number of positive ions and negative ions are determined by the electric potential difference between the first AC voltage applied to the first electrode and the second AC voltage applied to the second electrode. Owing thereto, in comparison with the inventions of U.S. Pat. No. 6,693,788, Japanese Laid-Open Patent Publication No. 2008-288072, and International Publication No. WO2007/122742, even if the voltage levels of the AC voltages applied to the first electrode and the second electrode are comparatively low, positive ions and negative ions can be generated thereby.

In addition, if the high voltage generating unit is constituted so as to be capable of adjusting a duty ratio of the second AC voltage for the purpose of adjusting an ion balance of the static charge elimination region, elimination of static electricity can be carried out with high efficiency. Further, preferably, the adjustment of the ion balance is performed in advance before the elimination operation of static electricity is performed by the ionizer at the static charge elimination region.

Preferably, the ionizer according to the present invention includes a controller for controlling the high voltage generating unit, so as to apply the first AC voltage to the first electrode, and to apply the second AC voltage to the second electrode. Owing thereto, in accordance with control signals from the controller, the high voltage generating unit is capable of applying the first AC voltage to the first electrode, and of applying the second AC voltage to the second electrode.

Further, the high voltage generating unit is capable of setting a voltage level of the second AC voltage, which is applied to the second electrode within a timespan during which the second electrode is planned to be of negative polarity, substantially to zero, within a timespan during which the first electrode is of positive polarity as a result of application of the first AC voltage thereto. On the other hand, the high voltage generating unit is capable of setting a voltage level of the second AC voltage, which is applied to the second electrode within a timespan during which the second electrode is planned to be of positive polarity, substantially to zero, within a timespan during which the first electrode is of negative polarity as a result of application of the first AC voltage thereto.

In this manner, in predetermined timespans during which the polarity of the second electrode is opposite in polarity with respect to the polarity of the first electrode, by setting the voltage level of the second AC voltage applied to the second electrode substantially to a zero level (ground level), compared to a case of applying voltages to both the first electrode and the second electrode, because the potential difference between the first electrode and the second electrode becomes smaller, the load on the high voltage generating unit can be made lighter.

If the aforementioned potential difference is kept small, the generated amount of ions is reduced. However, even if the generated amount of ions is reduced, in the case that the static charge elimination effect can be expected to a certain degree, by affirmatively setting the voltage level to ground level, abrasion and wear on the first electrode and the second electrode (i.e., abrasion and wear at the tip end portions of the needle electrodes) can be suppressed.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

A preferred embodiment of an ionizer according to the present invention shall be described below with reference to FIGS. 1 through 7B, in relation to a static charge elimination method carried out thereby. For facilitating such explanations, in FIGS. 1 through 7B, portions of the structural elements thereof are shown as exaggerated or schematic representations.

The ionizer 10 according to the present embodiment is a static charge eliminating apparatus for eliminating static electricity (charge) that has electrically charged a body (workpiece, static charge elimination region) 12, which may comprise a resin frame, rubber, a semiconductor wafer, or a electronic substrate or the like, and includes a controller (control means) 14, a high voltage generating unit 16, and needle electrodes 18*a*, 18*b*.

The needle electrodes 18*a*, 18*b* are arranged in parallel in a state in which the tip ends thereof are directed toward the body 12. The high voltage generating unit 16 is an AC high voltage generator, which applies a first AC voltage to one of the needle electrodes (first electrode) 18*a*, and applies a second AC voltage to another of the needle electrodes (second electrode) 18*b*. The controller 14, by outputting control signals to the high voltage generating unit 16, controls application of AC voltages with respect to the needle electrodes 18*a*, 18*b* from the high voltage generating unit 16.

The structure of the ionizer 10 according to the present embodiment is basically as described above. Next, with reference to FIGS. 2A through 7B, explanations shall be made concerning characteristic functions (a static charge eliminating method) effected by the present embodiment.

Figure 1:
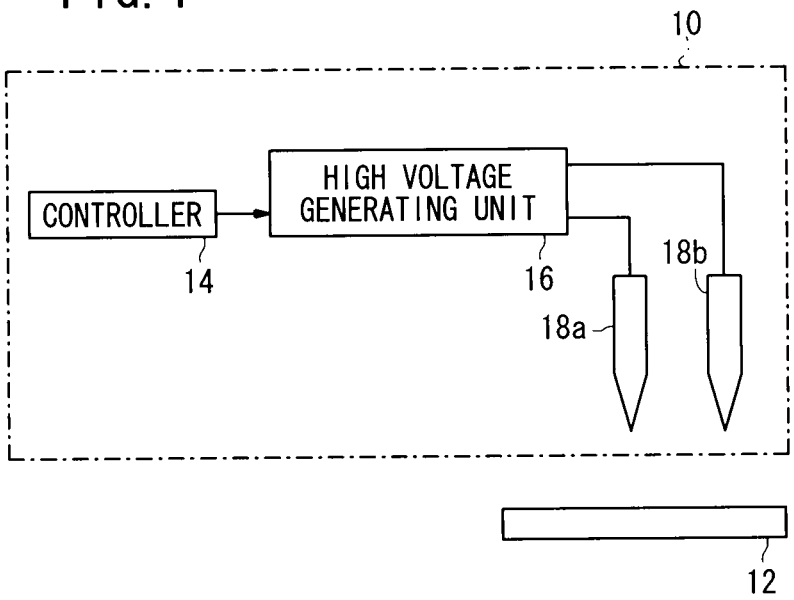
FIG. 1 is an outline block diagram of an ionizer according to an embodiment of the present invention.
Figure 2A:
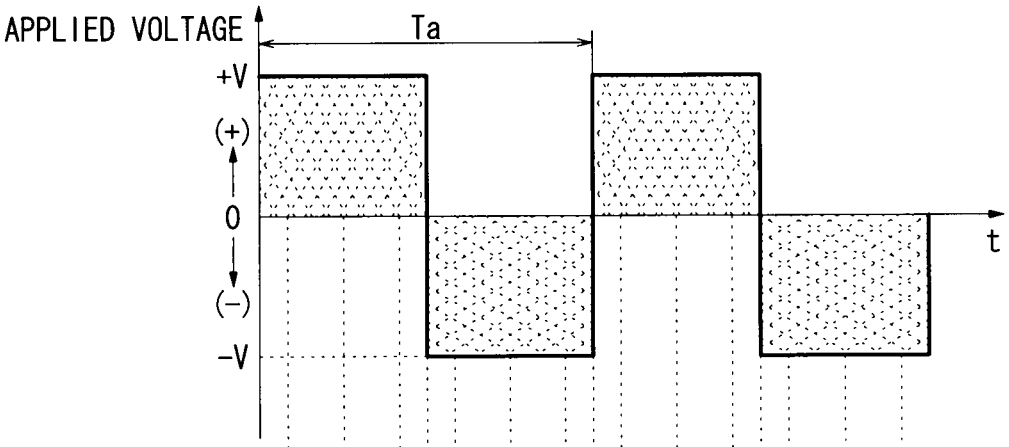
FIG. 2A is a time chart showing the waveform of a first AC voltage, which is applied to a first electrode.
Figure 2B:
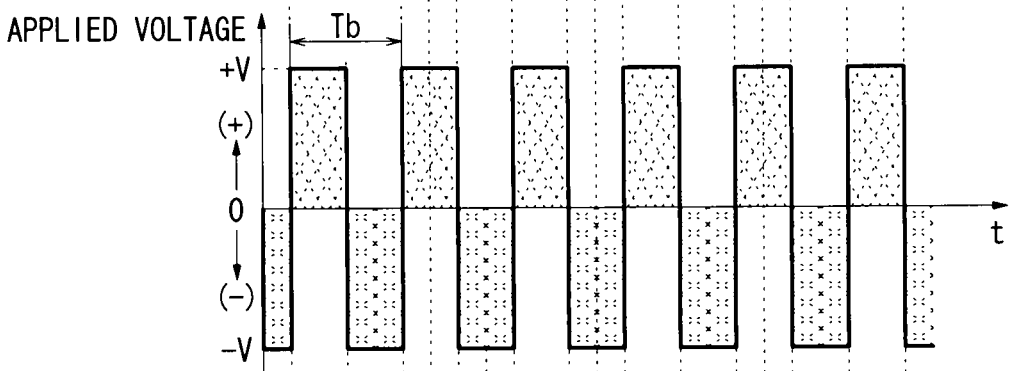
FIG. 2B is a time chart showing the waveform of a second AC voltage, which is applied to a second electrode.
Figure 2C:
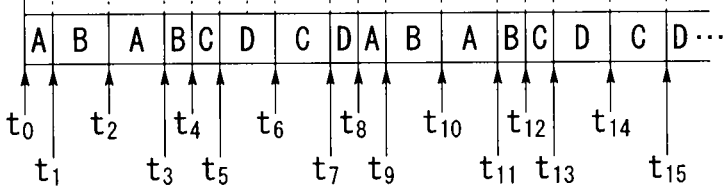
FIG. 2C is a time chart showing operation modes of the ionizer.

FIG. 2A shows an AC voltage waveform that is applied to one of the needle electrodes 18*a*, and FIG. 2B shows an AC voltage waveform that is applied to another of the needle electrodes 18*b*. FIG. 2C shows time-dependent changes in operation modes of the ionizer 10 when the AC voltage of FIG. 2A is applied to the needle electrode 18*a*, while the AC voltage of FIG. 2B is applied to the needle electrode 18*b*.

Herein, the first AC voltage applied to the needle electrode 18*a* is an AC voltage having a period $T_a$ (and a frequency $f_a=1/T_a$), whereas the second AC voltage applied to the needle electrode 18*b* is an AC voltage having a period $T_b$ (and a frequency $f_b=1/T_b$). In this case, among the first AC voltage and the second AC voltage, the periods and frequencies thereof are set such that $T_a=3T_b$ ($f_b=3f_a$).

Further, at timings indicated by times $t_0$, $t_4$, $t_8$, $t_{12}$, the polarity of the first AC voltage is switched between positive and negative (+V, −V voltage levels). On the other hand, at timings indicated by times $t_1$, $t_2$, $t_3$, $t_5$, $t_6$, $t_7$, $t_9$, $t_{10}$, $t_{11}$, $t_{13}$, $t_{14}$, $t_{16}$, the polarity of the second AC voltage is switched between positive and negative (+V, −V voltage levels). More specifically, in the present embodiment, the positive/negative polarity switchover timing of the second AC voltage is shifted with respect to the positive/negative polarity switchover timing of the first AC voltage. As a consequence thereof, AC voltages, of which the positive/negative polarity switchover timings thereof are mutually shifted, are applied respectively with respect to the one needle electrode 18*a* and the other needle electrode 18*b*.

The aforementioned periods $T_a$, $T_b$ (frequencies $f_a$, $f_b$) of the first AC voltage and the second AC voltage, the positive/negative polarity switchover timings (times $t_0$ through $t_{15}$), and the voltage levels (+V, −V) are all determined (set) in the controller 14. Accordingly, the controller 14 outputs control signals indicative of such determined contents (set contents) to the high voltage generating unit 16, and the high voltage generating unit 16, following the set contents indicated from the control signals, applies the first AC voltage to the one needle electrode 18*a*, and applies the second AC voltage to the other needle electrode 18*b*.

In addition, by applying the second AC voltage to the needle electrode 18*b* together with applying the first AC voltage to the needle electrode 18*a*, as shown in FIG. 2C, operation modes of the ionizer 10 are switched, in accordance with the polarity of the first AC voltage and the polarity of the second AC voltage, at each of the aforementioned timings (times). As shall be discussed subsequently, such operation modes are defined by generation patterns or release patterns of positive ions 20 and negative ions 22 (see FIGS. 3A to 4B) in the ionizer 10.

Herein, Pattern A, as an operation mode, is indicative of a case in which a positive polarity voltage (+V applied voltage) is applied to the one needle electrode 18*a*, and a negative polarity voltage (−V applied voltage) is applied to the other needle electrode 18*b*. Pattern B is indicative of a case in which a positive polarity voltage (+V applied voltage) is applied both to the one needle electrode 18*a* and to the other needle electrode 18*b*. Pattern C is indicative of a case in which a negative polarity voltage (−V applied voltage) is applied to the one needle electrode 18*a*, and a positive polarity voltage (+V applied voltage) is applied to the other needle electrode 18*b*. Pattern D is indicative of a case in which a negative polarity voltage (−V applied voltage) is applied both to the one needle electrode 18*a* and to the other needle electrode 18*b*.

Further, in FIG. 2C, an aspect of the invention is indicated, in which, at each of the times from time $t_0$ to time $t_{15}$, operation modes of the ionizer 10 are switched in succession as follows:

A→B→A→C→D→C→D→A→B→A→B→C→D→C→D→ . . . .

Next, explanations shall be made with reference to FIGS. 3A through 4B concerning operations of the ionizer 10 upon implementation of the patterns A through D.

Figure 3A:
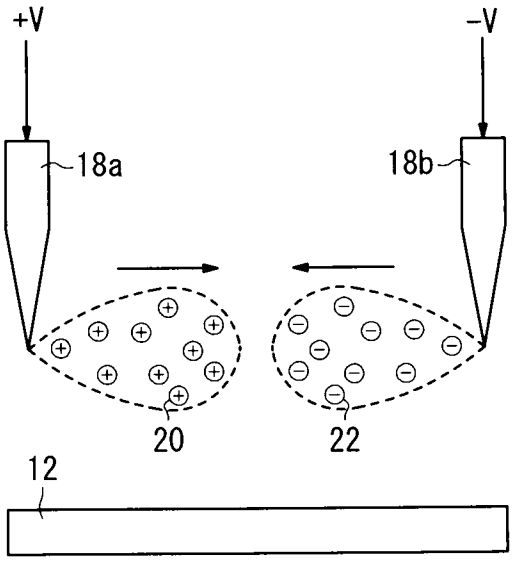
FIG. 3A is an explanatory diagram showing operation of the ionizer at a pattern A shown in FIG. 2C.

In pattern A shown in FIG. 3A, a non-illustrated electric field (lines of electric force) is formed between the needle electrode 18*a* of positive polarity (+V applied voltage) and the needle electrode 18*b* of negative polarity (−V applied voltage), whereupon electric field concentrations are formed respectively at each of the tip ends of the needle electrodes 18*a*, 18*b*. Corona discharges are generated at each of the tip ends by the electric field concentrations, and due to each of the generated corona discharges, respectively, positive ions 20 are generated in the vicinity of the tip end of the needle electrode 18*a*, whereas negative ions 22 are generated in the vicinity of the tip end of the needle electrode 18*b*. The positive ions 20 are directed toward the negative polarity needle electrode 18*b* along the lines of electric force, and together therewith, the negative ions 22 are directed toward the positive polarity needle electrode 18*a* along the lines of electric force. In FIG. 3A, the broken lines that surround the positive ions 20 and the negative ions 22 indicate groupings of positive ions 20 or negative ions 22, respectively.

Figure 3B:
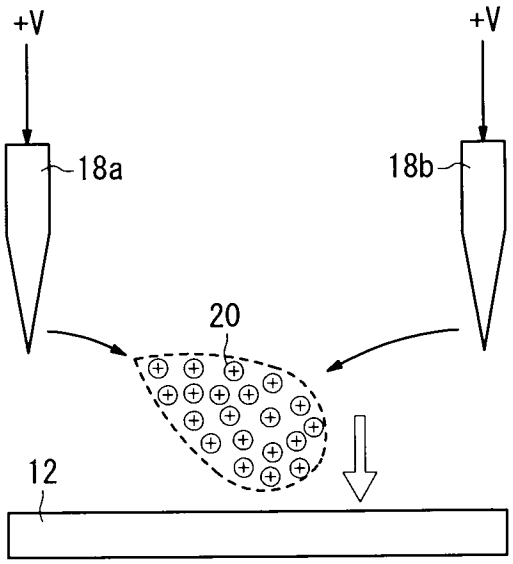
FIG. 3B is an explanatory diagram showing operation of the ionizer at a pattern B shown in FIG. 2C.

In pattern B shown in FIG. 3B, the needle electrodes 18*a*, 18*b* both are of positive polarity (+V applied voltage) and an electric field (lines of electric force) is formed between the needle electrodes 18*a*, 18*b* and ground, whereupon, as a result of electric field concentrations formed at the tip ends of each of the needle electrodes 18*a*, 18*b*, corona discharges are generated in the vicinity of each of such tip ends. Due to the generated corona discharges, respectively, positive ions 20 are generated in the vicinity of the tip ends of the needle electrodes 18*a*, 18*b*, whereas the negative ions 22, which were generated during Pattern A (see FIG. 2C) immediately prior to the timespan of Pattern B, are induced and absorbed at the tip ends of each of the needle electrodes 18*a*, 18*b*. In this case, because the polarities of the positive ions 20 generated in Pattern B and of the positive ions 20 generated in Pattern A are of the same polarity as the polarity of the AC voltage (+V) applied to the needle electrodes 18*a*, 18*b*, a repulsive force operates between the grouping of positive ions 20 and the needle electrodes 18*a*, 18*b*, and as a result, the grouping of positive ions 20 are released toward the body 12 while passing through an non-illustrated opening of the ionizer 10. Accordingly, the grouping of positive ions 20 that reaches the body 12 serves to eliminate static electricity, which has charged the body 12, reliably and with good efficiency.

Figure 4A:
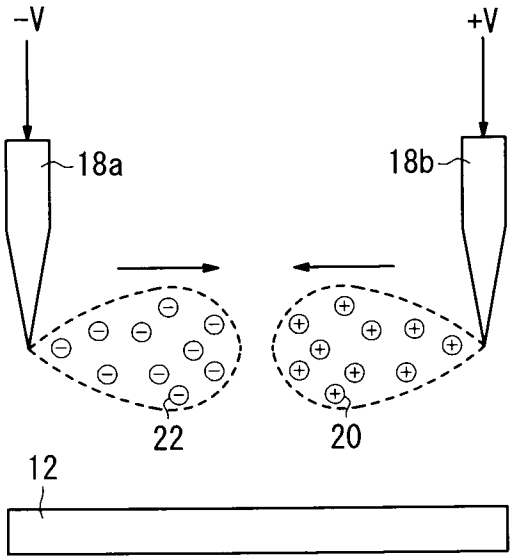
FIG. 4A is an explanatory diagram showing operation of the ionizer at a pattern C shown in FIG. 2C.

In pattern C shown in FIG. 4A, a non-illustrated electric field (lines of electric force) is formed between the needle electrode 18*a* of negative polarity (−V applied voltage) and the needle electrode 18*b* of positive polarity (+V applied voltage), whereupon electric field concentrations are formed respectively at each of the tip ends of the needle electrodes 18*a*, 18*b*. Corona discharges are generated at each of the tip ends by the electric field concentrations, and due to each of the generated corona discharges, respectively, negative ions 22 are generated in the vicinity of the tip end of the needle electrode 18*a*, whereas positive ions 20 are generated in the vicinity of the tip end of the needle electrode 18*b*. The negative ions 22 are directed toward the positive polarity needle electrode 18*b* along the lines of electric force, and together therewith, the positive ions 20 are directed toward the negative polarity needle electrode 18*a* along the lines of electric force.

Figure 4B:
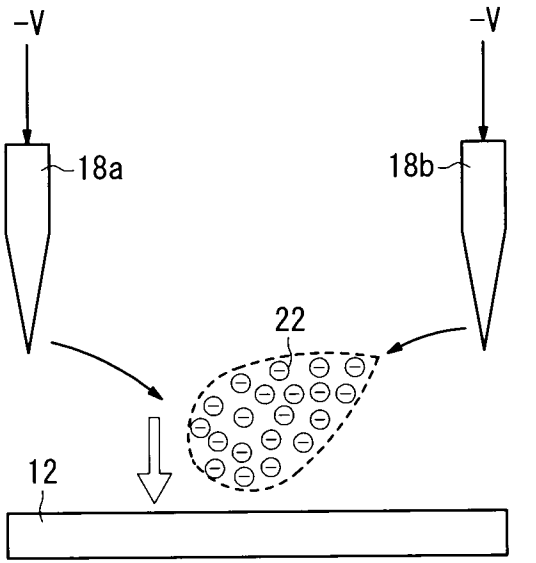
FIG. 4B is an explanatory diagram showing operation of the ionizer at a pattern D shown in FIG. 2C.

In pattern D shown in FIG. 4B, the needle electrodes 18*a*, 18*b* both are of negative polarity (−V applied voltage) and an electric field (lines of electric force) is formed between the needle electrodes 18*a*, 18*b* and ground, whereupon, as a result of electric field concentrations formed at the tip ends of each of the needle electrodes 18*a*, 18*b*, corona discharges are generated in the vicinity of each of such tip ends. Due to the generated corona discharges, respectively, negative ions 22 are generated in the vicinity of the tip ends of the needle electrodes 18*a*, 18*b*, whereas the positive ions 20, which were generated during Pattern C (see FIG. 2C) immediately prior to the timespan of Pattern D, are induced and absorbed at the tip ends of each of the needle electrodes 18*a*, 18*b*. In this case, because the polarities of the negative ions 22 generated in Pattern D and of the negative ions 22 generated in Pattern C are of the same polarity as the polarity of the AC voltage (−V) applied to the needle electrodes 18*a*, 18*b*, a repulsive force operates between the grouping of negative ions 22 and the needle electrodes 18*a*, 18*b*, and as a result, the grouping of negative ions 22 are released by the repulsive force toward the body 12 while passing through an non-illustrated opening of the ionizer 10. Accordingly, the grouping of negative ions 22 that reaches the body 12 serves to eliminate static electricity, which has charged the body 12, reliably and with good efficiency.

In this manner, according to the present embodiment, as shown in FIG. 2C, at each of the timings (times), since the operation modes (patterns A through D) of the ionizer 10 are switched, even if the body 12 is charged by either of negative or positive polarities, static electricity (positive or negative charge) of the body 12 can be eliminated with high efficiency by the groupings of positive ions 20 or the groupings of negative ions 22 that are released from the ionizer 10.

As described above, according to the ionizer 10 and the static charge elimination method of the present embodiment, the frequency $f_b$ of the second AC voltage applied to the other needle electrode 18*b* is set higher than the frequency $f_a$ of the first AC voltage applied to the one needle electrode 18*a* ($f_b > f_a$).

Consequently, in accordance with the polarities of the AC voltages applied to the needle electrodes 18*a*, 18*b*, timespans in which the AC voltages applied to the needle electrodes 18*a*, 18*b* are mutually different (i.e., Patterns A and C, in which one of the needle electrodes is of positive polarity, and the other of the needle electrodes is of negative polarity), and timespans in which the AC voltages applied to the needle electrodes 18*a*, 18*b* are mutually the same (i.e., Patterns B and D, in which one of the needle electrodes and the other of the needle electrodes are both of positive polarity or of negative polarity) are generated.

In this case, with Pattern A and Pattern C, positive ions 20 and negative ions 22 are generated respectively in the vicinity of each of the needle electrodes 18*a*, 18*b*. Further, with Pattern B and Pattern D, because the polarities of each of the needle electrodes 18*a*, 18*b* and of the ions generated in the vicinity of each of the needle electrodes 18*a*, 18*b* are mutually the same, as a result of repulsive forces generated between each of the needle electrodes 18*a*, 18*b* and the positive ions 20 or the negative ions 22, the positive ions 20 or the negative ions 22 are released from the ionizer 10 toward the body 12.

More specifically, with the present embodiment, because the ground electrodes 102 (see FIG. 8A and FIGS. 9A through 10) are not needed, the problems of U.S. Pat. No. 6,693,788 and Japanese Laid-Open Patent Publication No. 2008-288072, in which positive ions 106 and negative ions 108 are induced and absorbed by the ground electrodes 102, and the number of ions released toward the body 104 becomes reduced, can be avoided.

Further, since separately from the timespans (Pattern A and Pattern C) during which positive ions 20 and negative ions 22 are generated, timespans (Pattern B and Pattern D) are provided in which the positive ions 20 and the negative ions 22 are released to the body 12, it is unnecessary for such positive ions 20 and negative ions 22 to be released at a timing corresponding to a switch in polarity. Accordingly, positive ions 20 and negative ions 22 can be released reliably toward the body 12 without reducing the number of positive ions 20 and negative ions 22 that are generated.

Further, with the present embodiment, as discussed above, the frequency $f_b$ of the second AC voltage is set higher than the frequency $f_a$ of the first AC voltage. Owing thereto, in any of the aforementioned Patterns A through D, (a case occurs in which) the times thereof are shorter than the time of positive polarity or the time of negative polarity in the first AC voltage. However, with the present embodiment, by reciprocally repeating between Patterns A, C and Patterns B, D, before the positive ions 20 or the negative ions 22 are induced and absorbed by the needle electrodes 18*a*, 18*b* following switching in polarity thereof, by use of the repulsive force, the positive ions 20 or the negative ions 22 can be released as is toward the body 12.

Accordingly, with the present embodiment, the problems of International Publication No. WO2007/122742 also can be avoided.

In this manner, with the present embodiment, compared to the disclosures of U.S. Pat. No. 6,693,788, Japanese Laid-Open Patent Publication No. 2008-288072, and International Publication No. WO2007/122742, by providing the timespans (Pattern B and Pattern D) at which positive ions 20 and negative ions 22 are released by the repulsive force, the positive ions 20 and the negative ions 22 can be released efficiently and reliably toward the body 12. As a result, static electricity of the body 12 can be eliminated highly efficiently.

Stated otherwise, according to the present invention, even if ions are not generated in large quantities as in the inventions of U.S. Pat. No. 6,693,788, Japanese Laid-Open Patent Publication No. 2008-288072, and International Publication No. WO2007/122742, by setting the frequency $f_a$ of the first AC voltage and the frequency $f_b$ of the second AC voltage in accordance with the aforementioned relationship, the generated positive ions 20 and negative ions 22 are released reliably toward the body 12, whereby the efficiency with which static electricity is eliminated is increased. Owing thereto, it is unnecessary to dispose ground electrodes behind the needle electrodes 18*a*, 18*b*, or to increase the voltage level of the AC voltage that is applied to the needle electrodes 18*a*, 18*b*.

Accordingly, with the present embodiment, by improving the generation efficiency of ions (ion release efficiency), the charge elimination efficiency of static electricity at the body 12 can be increased. Owing thereto, a reduction in size and scale of the ionizer 10 can be realized.

Further, the high voltage generating unit 16 applies the second AC voltage to the needle electrode 18*b* in a state such that the positive/negative switchover timing of the second AC voltage is shifted with respect to a positive/negative switchover timing of the first AC voltage. Therefore, reciprocal repetition of the timespans (Pattern A, Pattern C) during which positive ions 20 and negative ions 22 are generated, and the timespans (Pattern B, Pattern D) during which either positive ions 20 or negative ions 22 are released to the body 12 can be realized reliably. As a result, the generation efficiency (irradiation efficiency) of the positive ions 20 and the negative ions 22 can be increased, and the efficiency with which static electricity is eliminated at the body 12 can be improved remarkably. In this manner, by improving the static charge elimination efficiency, the reliability of the ionizer 10 can be increased.

In addition, in the ionizer 10, since the needle electrodes 18*a*, 18*b* are used, large electric field concentrations are generated at the tip ends of the needle electrodes 18*a*, 18*b*, and by means of corona discharge caused by such electric field concentrations, positive ions 20 and negative ions 22 can easily be generated. More specifically, as stated previously, because the present invention is constituted without need for the ground electrodes 102, the degree of electric field concentration and the generated number of positive ions 20 and negative ions 22 are determined by the electric potential difference between the first AC voltage applied to the needle electrode 18*a* and the second AC voltage applied to the needle electrode 18*b*. Owing thereto, in comparison with the inventions of U.S. Pat. No. 6,693,788, Japanese Laid-Open Patent Publication No. 2008-288072, and International Publication No. WO2007/122742, even if the voltage levels of the AC voltages applied to the needle electrodes 18*a*, 18*b* are comparatively low, positive ions 20 and negative ions 22 can be generated thereby.

Furthermore, since control signals are output to the high voltage generating unit 16 from the controller 14, and in accordance with such control signals, the high voltage generating unit 16 applies the first AC voltage to the needle electrode 18*a* together with applying the second AC voltage to the needle electrode 18*b*, control of the AC voltages applied to the needle electrodes 18*a*, 18*b* can easily be carried out.

Although in the foregoing explanations, a case has been explained in which the number of needle electrodes 18*a*, 18*b* is two, the present embodiment is not limited thereby. Even if three or more of such needle electrodes are disposed in the ionizer 10, each of the aforementioned advantageous effects of the invention can be obtained.

Further, in the foregoing explanations, a case has been described in which the periods $T_a$, $T_b$ and frequencies $f_a$, $f_b$ are related by the equation $T_a=3T_b$ ($f_b=3f_a$). However, the present embodiment is not limited by this feature. If n is taken to represent a positive integer (n=1, 2, 3, . . . ), then the frequency $f_b$ of the second AC current may be set 3*n* times (three times, six times, nine times, . . . ) greater than the frequency $f_a$ of the first AC current ($f_b=3n\times f_a$).

Figure 5A:
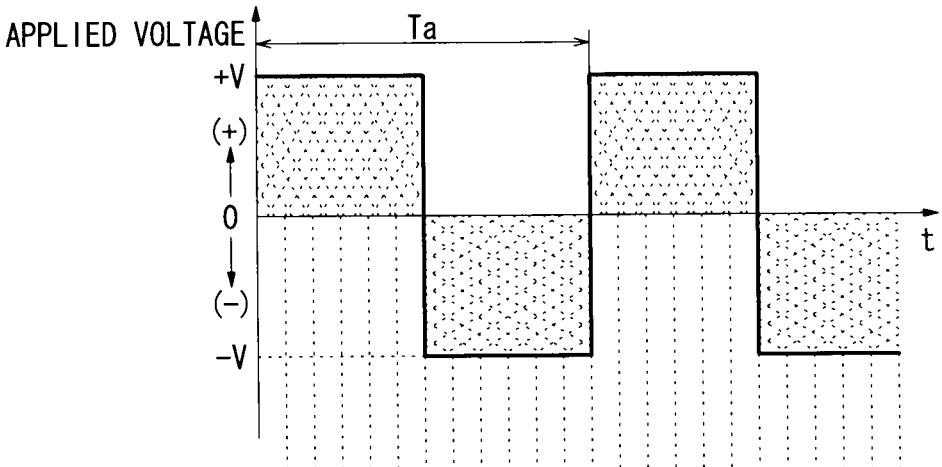
FIG. 5A is a time chart showing the waveform of a first AC voltage applied to a first electrode.
Figure 5B:
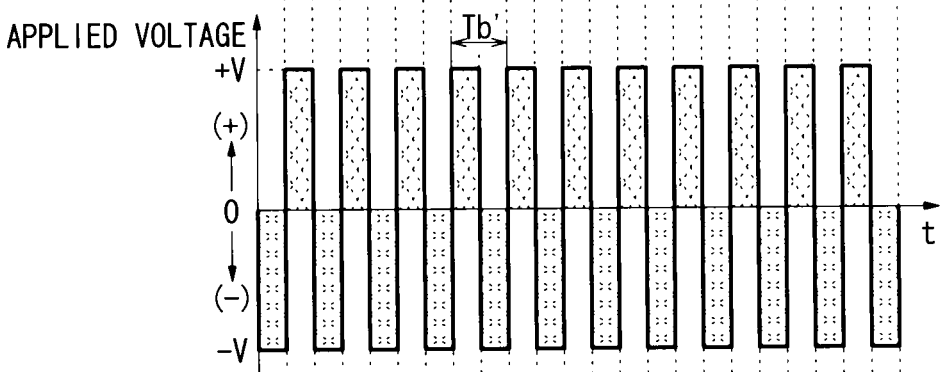
FIG. 5B is a time chart showing the waveform of a second AC voltage, which is applied to a second electrode.
Figure 5C:
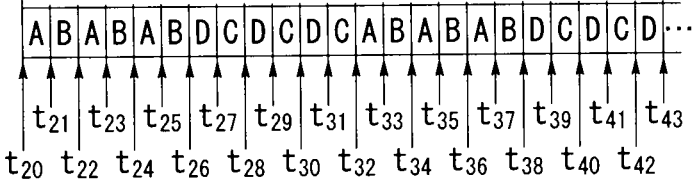
FIG. 5C is a time chart showing operation patterns of the ionizer.

FIGS. 5A to 5C illustrate other waveforms for the first AC voltage and the second AC voltage, in which, by applying the first AC voltage shown in FIG. 5A to the needle electrode 18*a* and by applying the second AC voltage shown in FIG. 5B to the needle electrode 18*b*, positive/negative polarities are switched at each of the timings (times) shown by times $t_{20}$ through $t_{43}$, resulting in the illustrated switching aspects of Patterns A through D. In FIGS. 5A through 5C, a case is illustrated in which respective frequencies $f_a$, $f_b$ and periods $T_a$, $T_b'$ are set such that $f_b=6f_a$ ($T_a=6T_b'$), and the positive/negative polarity switching of the first AC voltage and the second AC voltage is carried out synchronously at times $t_{26}$, $t_{32}$, $t_{38}$.

In this manner, according to the present embodiment, in accordance with the relationship $f_b=3n\times f_a$, ineffectual generation of positive ions 20 and negative ions 22 is avoided, and elimination of static electricity can be performed highly efficiently.

Further, as shown in FIGS. 5A to 5C, concerning the first AC voltage and the second AC voltage, because switching between positive and negative polarities is carried out synchronously at times $t_{26}$, $t_{32}$, $t_{38}$, the patterns before and after times $t_{26}$, $t_{32}$, $t_{38}$ are either the patterns B and D, or the patterns C and A, and thus cases occur in which the ions generated in the preceding pattern cannot be used as ions that are released toward the body 12 in the following pattern. Notwithstanding, even if patterns B and D or patterns C and A are allowed to continue, as far as overall operations of the ionizer 10 are concerned, because operation modes in which positive ions 20 and negative ions 22 are generated, and operation modes in which positive ions 20 and negative ions 22 are released to the static charge elimination space are repeated reciprocally, in this case as well, generated positive ions and negative ions can be released reliably toward the body 12, and elimination of static electricity can be carried out with good efficiency.

Further, with the present embodiment, preferably, prior to the operation of eliminating static electricity from the body by the ionizer 10, adjustment of the ion balance of the body 12 is carried out. In this case, the high voltage generating unit 16, in accordance with control signals from the controller 14, while taking into consideration the difference in movement speeds of the positive ions 20 and the negative ions 22, adjusts the ion balance by adjusting the duty ratio of the second AC voltage. As a result thereof, during the actual static electricity elimination operation, elimination of static electricity can be preformed highly efficiently.

Further, in the present embodiment, the method by which the second AC voltage is applied with respect to the needle electrode 18*b* is capable of being modified, to provide the application method shown in FIGS. 6A through 7B.

Figure 6A:
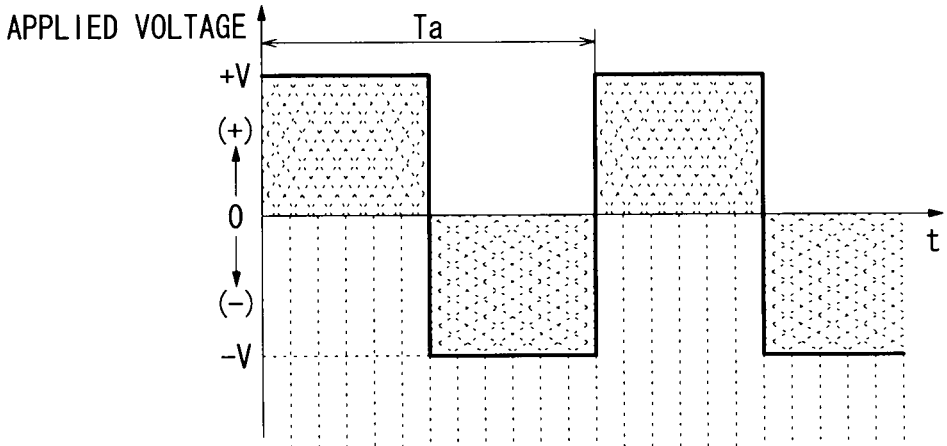
FIG. 6A is a time chart showing the waveform of a first AC voltage applied to a first electrode.
Figure 6B:
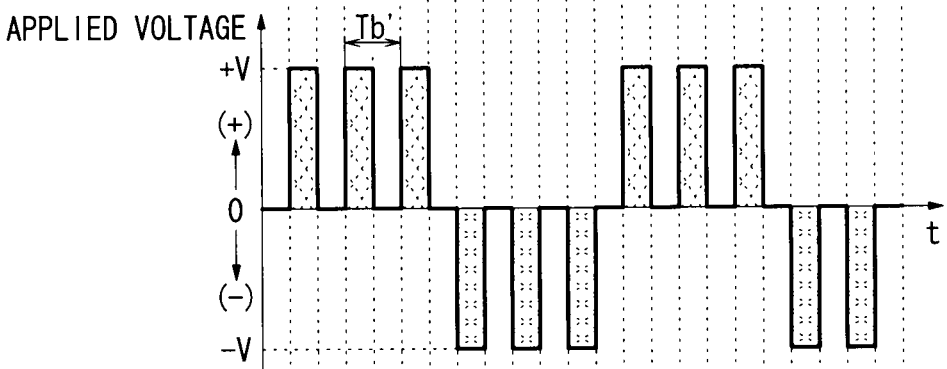
FIG. 6B is a time chart showing the waveform of a second AC voltage, which is applied to a second electrode.

More specifically, the high voltage generating unit 16 (see FIG. 1) sets the voltage level of the second AC voltage applied to the needle electrode 18*b* substantially to a zero level (ground level) at timespans when the needle electrode 18*b* is planned to be negative in polarity (i.e., at each of the timespans $t_{20}$ to $t_{21}$, $t_{22}$ to $t_{23}$, $t_{24}$ to $t_{25}$, $t_{32}$ to $t_{33}$, $t_{34}$ to $t_{35}$, and $t_{36}$ to $t_{37}$ in FIG. 6B), during timespans in which the needle electrode 18*a* is made positive in polarity by application of the first AC voltage (i.e., during each of the timespans from times $t_{20}$ to $t_{26}$ and from times $t_{32}$ to $t_{38}$ in FIG. 6A).

Further, the high voltage generating unit 16 sets the voltage level of the second AC voltage applied to the needle electrode 18*b* substantially to ground level at timespans when the needle electrode 18*b* is planned to be positive in polarity (i.e., at each of the timespans $t_{26}$ to $t_{27}$, $t_{28}$ to $t_{29}$, $t_{30}$ to $t_{31}$, $t_{38}$ to $t_{39}$, $t_{40}$ to $t_{41}$, and $t_{42}$ to $t_{43}$ in FIG. 6B), during timespans in which the needle electrode 18*a* is made negative in polarity by application of the first AC voltage (i.e., during each of the timespans from times $t_{26}$ to $t_{32}$ and from times $t_{38}$ and thereafter in FIG. 6A).

In this case, at timespans when voltages (positive voltages or negative voltages) are of the same polarity in the needle electrode 18*a* and the needle electrode 18*b*, the operation modes of the ionizer 10 become that of the aforementioned Pattern B (see FIG. 3B) or Pattern D (see FIG. 4B).

Figure 6C:
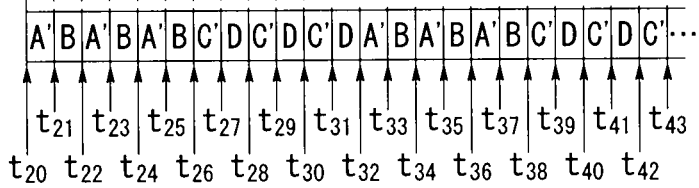
FIG. 6C is a time chart showing operation patterns of the ionizer.
Figure 7A:
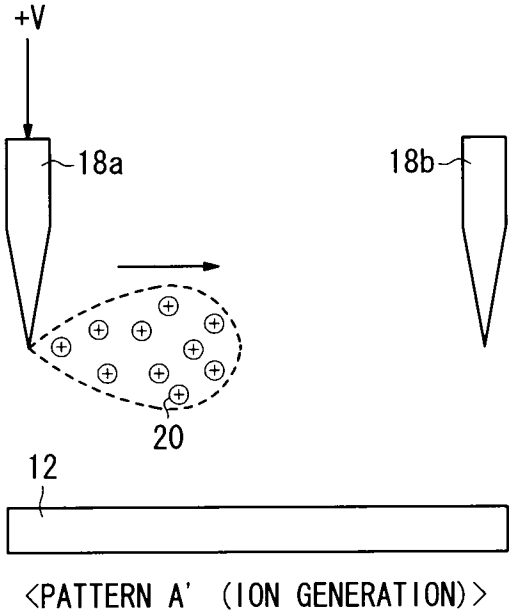
FIG. 7A is an explanatory diagram showing operations of the ionizer at a pattern A' shown in FIG. 6C.

In contrast thereto, during timespans when a positive polarity voltage is applied to the needle electrode 18*a*, and the voltage of the needle electrode 18*b* is at ground level (i.e., at each of the timespans $t_{20}$ to $t_{21}$, $t_{22}$ to $t_{23}$, $t_{24}$ to $t_{25}$, $t_{32}$ to $t_{33}$, $t_{34}$ to $t_{35}$, and $t_{36}$ to $t_{37}$ in FIG. 6B), the operation mode of the ionizer 10 becomes that of Pattern A' (see FIGS. 6C and 7A).

Pattern A' defines an operation mode in which corona discharge is generated in the vicinity of the tip end of the needle electrode 18*a*, caused by an electric field concentration at the tip end of the needle electrode 18*a* due to a non-illustrated electric field (lines of electric force) formed between the positive polarity needle electrode 18*a* and the ground level needle electrode 18*b*. Positive ions 20 caused by the generated corona discharge are generated in the vicinity the aforementioned tip end, and such positive ions 20 are directed toward the needle electrode 18*b* along the lines of electric force.

Figure 7B:
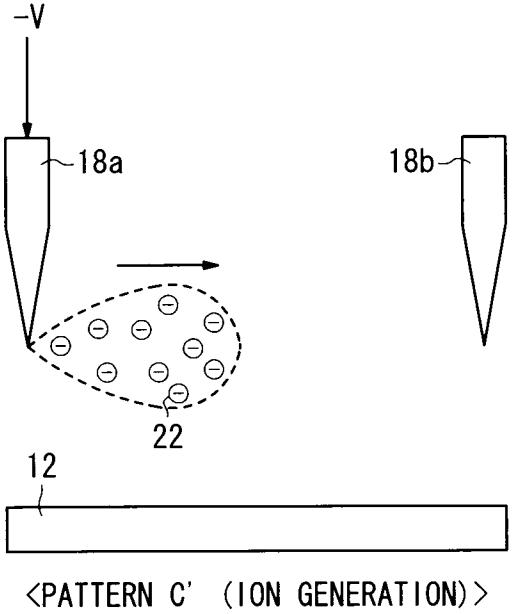
FIG. 7B is an explanatory diagram showing operations of the ionizer at a pattern C' shown in FIG. 6C.
Figure 8A:
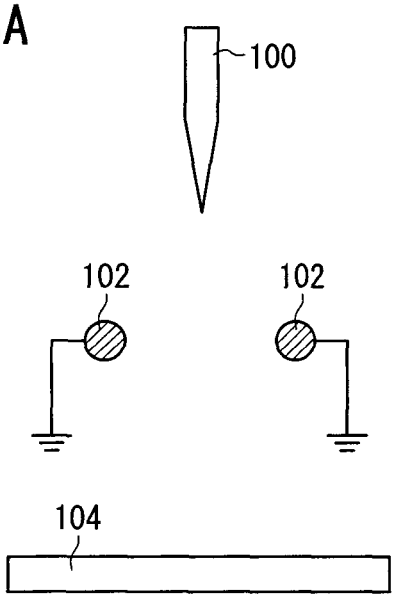
RELATED ART FIG. 8A
FIG. 8A is an explanatory diagram showing schematically an ionizer according to the specification of U.S. Pat. No. 6,693,788.
Figure 8B:
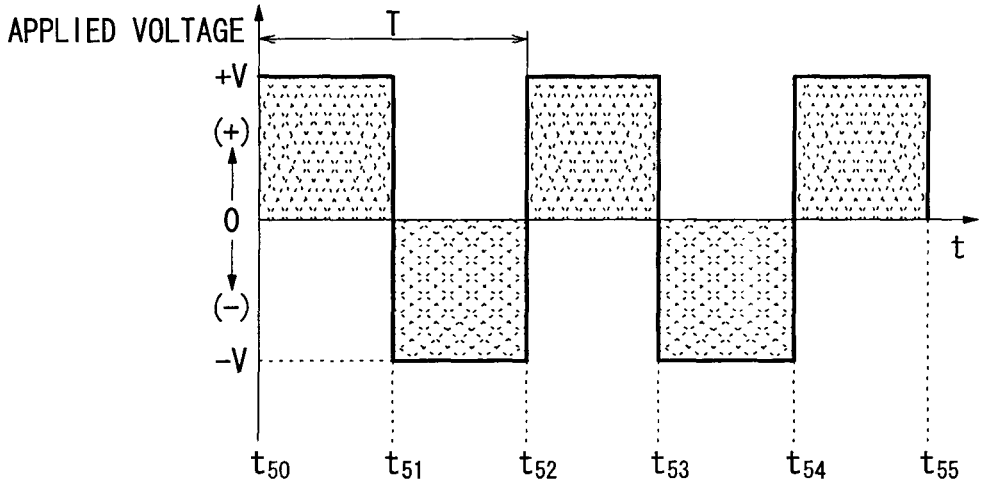
RELATED ART FIG. 8B
FIG. 8B is a time chart showing the waveform of an AC voltage applied to needle electrodes shown in FIG. 8A.
Figure 9B:
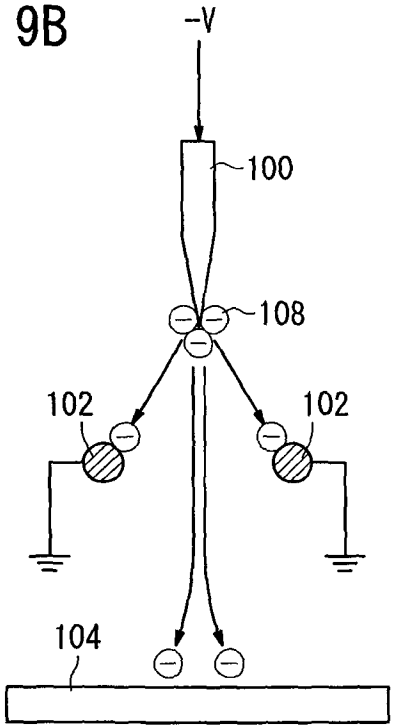
RELATED ART FIG. 9B
FIG. 9B is an explanatory diagram showing operation of the ionizer at a time when an applied voltage having a negative polarity is applied to the needle electrode shown in FIG. 8A.
Figure 9A:
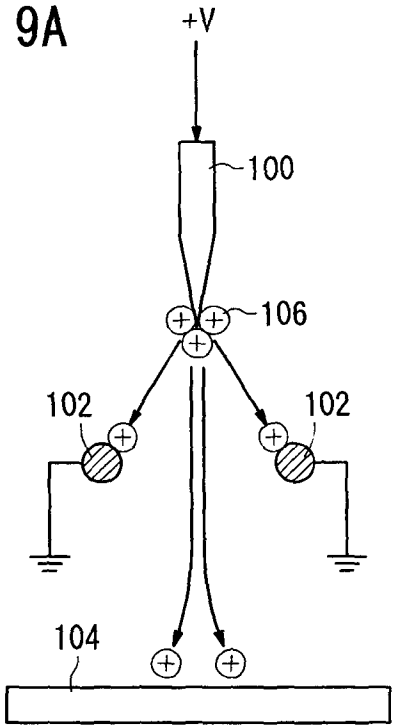
RELATED ART FIG. 9A
FIG. 9A is an explanatory diagram showing operation of the ionizer at a time when an applied voltage having a positive polarity is applied to the needle electrode shown in FIG. 8A.
Figure 10:
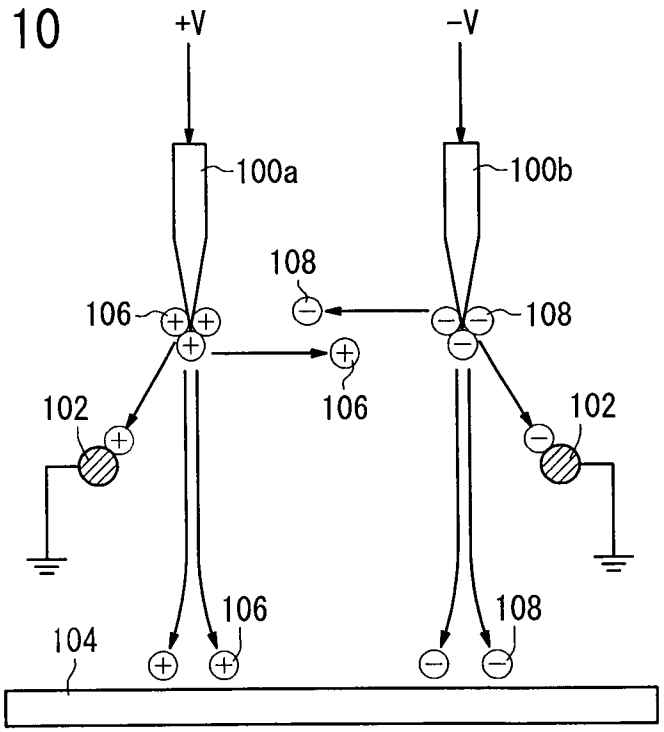
RELATED ART FIG. 10
FIG. 10 is an explanatory diagram showing schematically an ionizer according to Japanese Laid-Open Patent Publication No. 2008-288072.
Figure 11A:
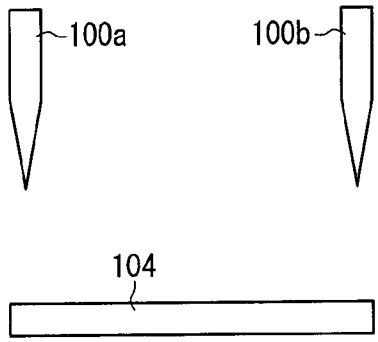
RELATED ART FIG. 11A
FIG. 11A is an explanatory diagram showing schematically an ionizer according to International Publication No. WO2007/122742.
Figure 11B:
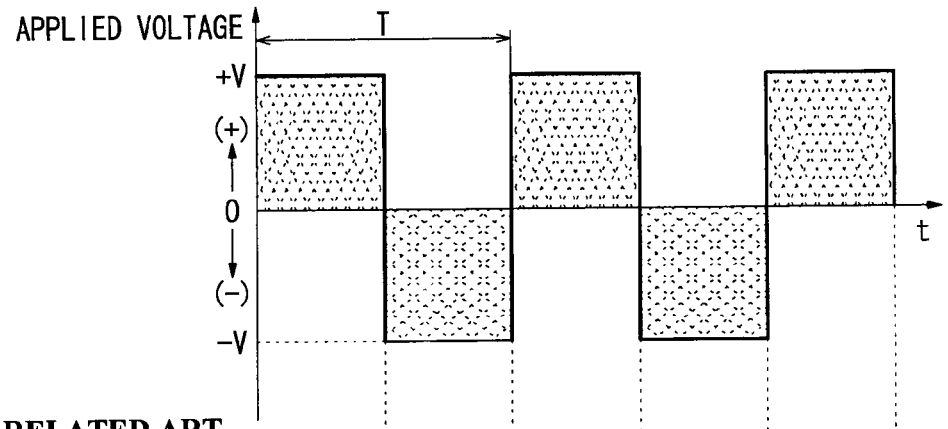
RELATED ART FIG. 11B
FIG. 11B is a time chart showing the waveform of an AC voltage, which is applied to one needle electrode shown in FIG. 11A.
Figure 11C:
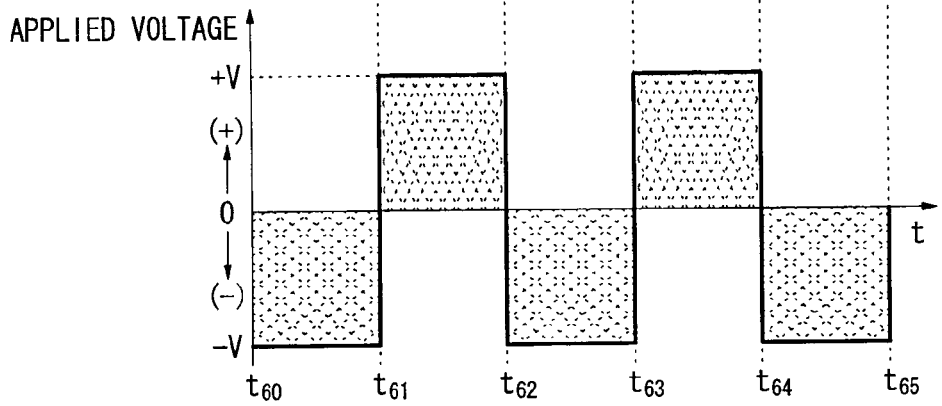
RELATED ART FIG. 11C
FIG. 11C is a time chart showing the waveform of an AC voltage, which is applied to another needle electrode shown in FIG. 11A.
Figure 12B:
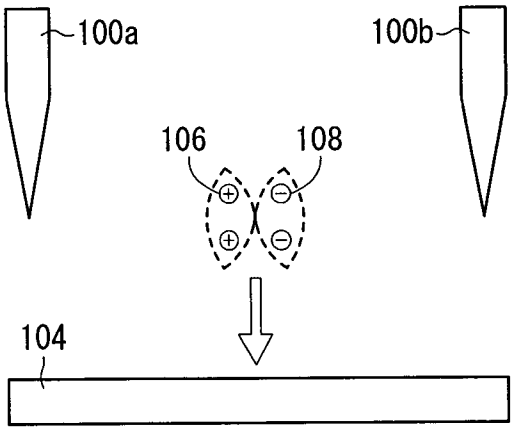
RELATED ART FIG. 12B
FIG. 12B is an explanatory diagram showing operation of the ionizer at a time when the AC voltage is switched between positive and negative.
Figure 12A:
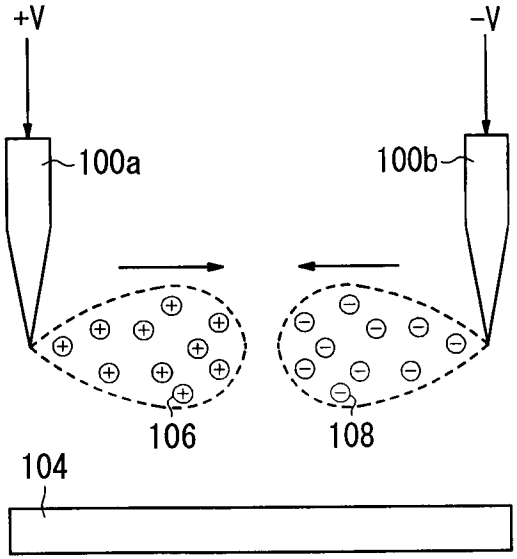
RELATED ART FIG. 12A
FIG. 12A is an explanatory diagram showing operation of the ionizer at a time when an AC voltage is applied to the needle electrodes shown in FIG. 11A.

On the other hand, during timespans when a negative polarity voltage is applied to the needle electrode 18*a*, and the voltage of the needle electrode 18*b* is at ground level (i.e., at each of the timespans $t_{26}$ to $t_{27}$, $t_{28}$ to $t_{29}$, $t_{30}$ to $t_{31}$, $t_{38}$ to $t_{39}$, $t_{40}$ to $t_{41}$, and $t_{42}$ to $t_{43}$ in FIG. 6B), the operation mode of the ionizer 10 becomes that of Pattern C' (see FIGS. 6C and 7B).

Pattern C' defines an operation mode in which corona discharge is generated in the vicinity of the tip end of the needle electrode 18*a*, caused by an electric field concentration at the tip end of the needle electrode 18*a* due to a non-illustrated electric field (lines of electric force) formed between the negative polarity needle electrode 18*a* and the ground level needle electrode 18*b*. Negative ions 22 caused by the generated corona discharge are generated in the vicinity the aforementioned tip end, and such negative ions 22 are directed toward the needle electrode 18*b* along the lines of electric force.

With the above-described Patterns A' and C', compared to a case in which voltages (+V, −V) are applied respectively to the two needle electrodes 18*a*, 18*b* as in Patterns A and C (see FIG. 2C, and FIGS. 3A and 4A), the potential difference between the needle electrode 18*a* and the needle electrode 18*b* is made smaller. More specifically, in Patterns A and C, the potential difference between the needle electrodes 18*a*, 18*b* is 2V (+V−(−V)=+2V), however, in Patterns A' and C', the potential difference is reduced by half and becomes V (+V−0=+V). Accordingly, with the application method according to FIGS. 6A to 7B, the load imposed on the voltage generating unit 16 can be lessened.

Incidentally, by making the potential difference small, the generated amount of ions is reduced. However, even if the generated amount of ions is reduced, in the case that the static charge elimination effect with respect to the body 12 can be expected to a certain degree, by affirmatively setting the voltage level of the needle electrode 18*b* to ground level, abrasion and wear on the tip end portions of the needle electrodes 18*a*, 18*b* can be suppressed.

The present invention is not limited to the above-described embodiments, and it is a matter of course that various modified or additional structures could be adopted without deviating from the essential scope of the present invention as set forth in the appended claims.

What is claimed is:

1. An ionizer comprising:

at least two electrodes; and a high voltage generating unit for applying a first AC voltage to a first electrode from among the at least two electrodes, and for applying a second AC voltage, having a frequency higher than a frequency of the first AC voltage, to a second electrode from among the at least two electrodes, wherein the high voltage generating unit sets, substantially to zero, for a total length of time equal to half of a first half-period timespan, a first voltage level of the second AC voltage, which is applied to the second electrode within a timespan during which the second electrode is planned to be of negative polarity as a result of application of the second AC voltage to the second electrode, within the first half-period timespan during which the first electrode is of positive polarity as a result of application of the first AC voltage to the first electrode, thereby generating positive ions, only in the vicinity of the first electrode, whereas releasing positive ions generated in the vicinity of the first electrode and the second electrode to a static charge elimination region within a timespan during which the second electrode is of positive polarity as a result of application of the second AC voltage to the second electrode, the first voltage level of the second AC voltage being non-negative during the first half-period timespan during which the first electrode is of positive polarity, and the high voltage generating unit sets, substantially to zero, for a total length of time equal to half of a second half-period timespan, a second voltage level of the second AC voltage, which is applied to the second electrode within a timespan during which the second electrode is planned to be of positive polarity as a result of application of the second AC voltage to the second electrode, within the second half-period timespan during which the first electrode is of negative polarity as a result of application of the first AC voltage to the first electrode, thereby generating negative ions, only in the vicinity of the first electrode, whereas releasing negative ions generated in the vicinity of the first electrode and the second electrode to the static charge elimination region within a timespan during which the second electrode is of negative polarity as a result of application of the second AC voltage to the second electrode, the second voltage level of the second AC voltage being non-positive during the second half-period timespan during which the first electrode is of negative polarity.

2. The ionizer according to claim 1, wherein, when n is taken as a positive integer, the frequency of the second AC voltage is 3n times greater than the frequency of the first AC voltage.

3. The ionizer according to claim 1, wherein the high voltage generating unit applies the second AC voltage to the second electrode in a state wherein a positive/negative switchover timing of the second AC voltage is shifted with respect to a positive/negative switchover timing of the first AC voltage.

4. The ionizer according to claim 1, wherein the first electrode and the second electrode comprise needle electrodes.

5. The ionizer according to claim 1, wherein, the high voltage generating unit is configured to adjust a duty ratio of the second AC voltage for the purpose of adjusting an ion balance of the static charge elimination region.

6. The ionizer according to claim 1, further comprising a controller for controlling the high voltage generating unit, so as to apply the first AC voltage to the first electrode, and to apply the second AC voltage to the second electrode.

7. A method for eliminating static charge, comprising the steps of:

generating positive ions and negative ions by applying a first AC voltage to a first electrode from among at least two electrodes, and by applying a second AC voltage, having a frequency higher than a frequency of the first AC voltage, to a second electrode from among the at least two electrodes;

eliminating static charge of a static charge elimination region by releasing the generated positive ions or the generated negative ions to the static charge elimination region;

setting, substantially to zero, for a total length of time equal to half of a first half-period timespan, a first voltage level of the second AC voltage, which is applied to the second electrode within a timespan during which the second electrode is planned to be of negative polarity as a result of application of the second AC voltage to the second electrode, within the first half-period timespan during which the first electrode is of positive polarity as a result of application of the first AC voltage to the first electrode, thereby generating positive ions, only in the vicinity of the first electrode, whereas releasing positive ions generated in the vicinity of the first electrode and the second electrode to the static charge elimination region within a timespan during which the second electrode is of positive polarity as a result of application of the second AC voltage to the second electrode, the first voltage level of the second AC voltage being non-negative during the first half-period timespan during which the first electrode is of positive polarity; and setting, substantially to zero, for a total length of time equal to half of a second half-period timespan, a second voltage level of the second AC voltage, which is applied to the second electrode within a timespan during which the second electrode is planned to be of positive polarity as a result of application of the second AC voltage to the second electrode, within the second half-period timespan during which the first electrode is of negative polarity as a result of application of the first AC voltage to the first electrode, thereby generating negative ions, only in the vicinity of the first electrode, whereas releasing negative ions generated in the vicinity of the first electrode and the second electrode to the static charge elimination region within a timespan during which the second electrode is of negative polarity as a result of application of the second AC voltage to the second electrode, the second voltage level of the second AC voltage being non-positive during the second half-period timespan during which the first electrode is of negative polarity.

* * * * *